US006854375B2

(12) United States Patent
Cangelosi

(10) Patent No.: US 6,854,375 B2
(45) Date of Patent: Feb. 15, 2005

(54) OPEN LOOP MINESWEEPING SYSTEM

(75) Inventor: Joseph S. Cangelosi, Levittown, NY (US)

(73) Assignee: Edo Corporation, Amityville, NY (US)

( * ) Notice: Subject to any disclaimer, the term of this patent is extended or adjusted under 35 U.S.C. 154(b) by 0 days.

(21) Appl. No.: 10/641,659

(22) Filed: Aug. 15, 2003

(65) Prior Publication Data

US 2004/0055450 A1 Mar. 25, 2004

Related U.S. Application Data

(62) Division of application No. 09/855,290, filed on May 15, 2001, now Pat. No. 6,634,273.

(51) Int. Cl.[7] ..... B64D 1/04

(52) U.S. Cl. ..... 89/1.13; 114/221 R; 102/402; 340/852

(58) Field of Search ..... 89/1.13; 114/221 R; 102/402; 340/852

(56) References Cited

U.S. PATENT DOCUMENTS 2,937,611 A * 5/1960 Schaelchlin et al. .... 114/221 R
3,940,732 A * 2/1976 Hudson et al. ..... 340/852
5,323,726 A * 6/1994 Olsson ..... 114/221 R
6,213,021 B1 * 4/2001 Pickett ..... 102/402

* cited by examiner

*Primary Examiner*—Michael Carone
*Assistant Examiner*—M. Thomson
(74) *Attorney, Agent, or Firm*—Kilgannon & Steidl

(57) ABSTRACT

An open loop magnetic field minesweeping system, with a small and light weight body to be towed through seawater by a towing cable from a helicopter or other vehicle, a single sweep cable extending rearwardly a substantial distance from the body with a first electrode in cable, sleeve or sock form attached to the end of the sweep cable, and a second electrode positioned forwardly of the body to be towed and extending along and connected to the towing cable. A rectifier and transformer on the body convert AC power fed to the towed body from the towing vehicle, to DC power applied across the first and second electrodes. A plurality of fairings attached to the towing cable each have an electrically conductive portion electrically isolated from the towing cable. The electrically conductive portions are electrically connected together to form the second electrode. Each fairing has a plastic nose piece attached to the towing cable and an electrically conductive metal tail piece.

2 Claims, 4 Drawing Sheets

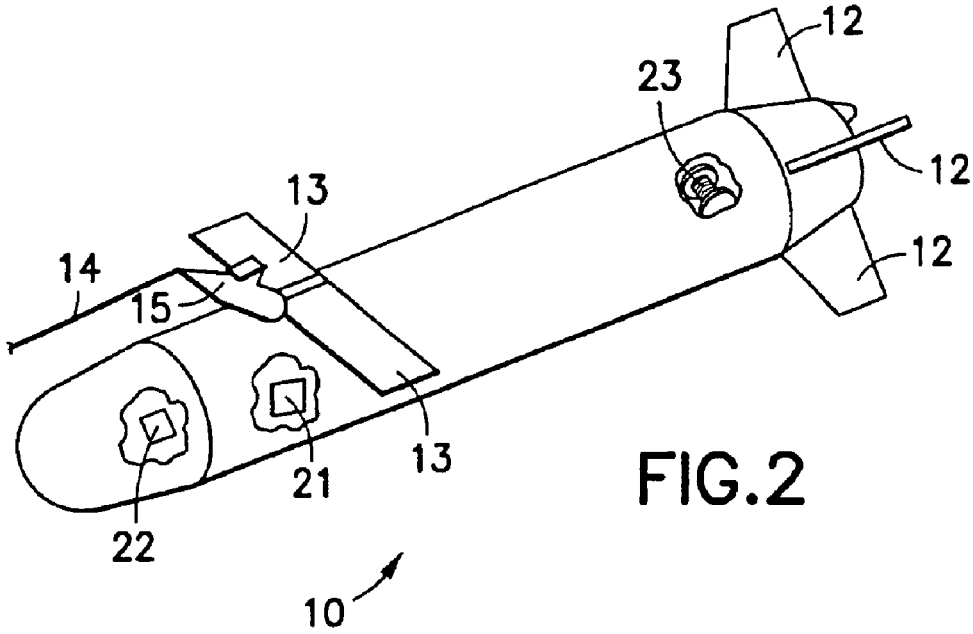
FIG.2
FIG.5
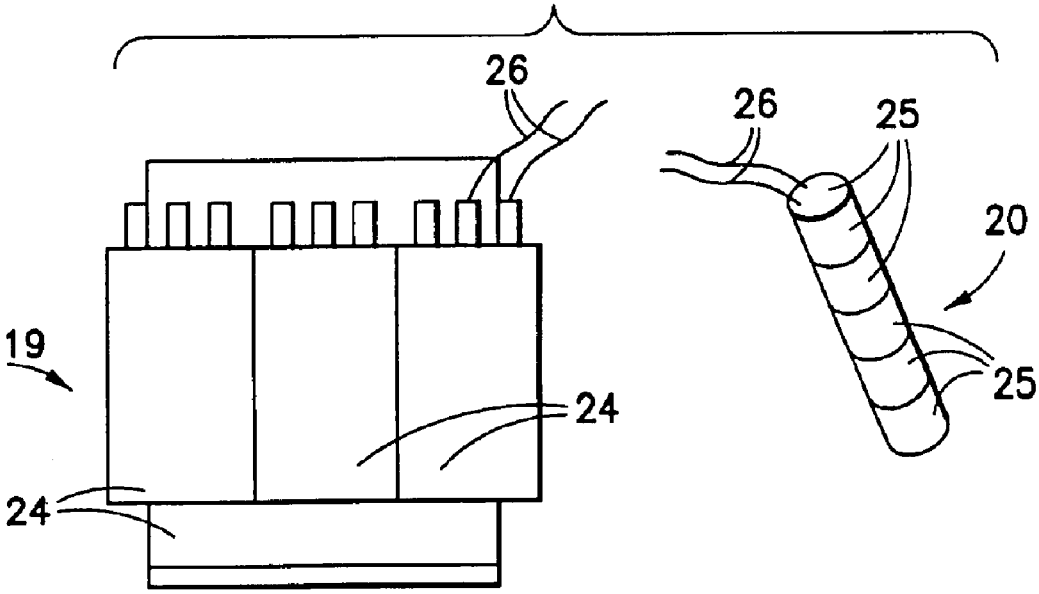

OPEN LOOP MINESWEEPING SYSTEM

This application is a divisional application of U.S. patent application Ser. No. 09/855,290 now U.S. Pat No. 6,634,273 filed on May 15, 2001 naming Joseph S. Cangelosi as inventor.

FIELD OF THE INVENTION

The present invention relates to minesweeping equipment, and more particularly to equipment that will clear a body of water of mines that can be set off by influence signatures.

BACKGROUND OF THE INVENTION

A minesweeping system that creates influence signatures generally must provide a large enough influence field to be effective while still minimizing the size and weight of the equipment to make the system practical from the standpoint of the platform which controls and/or tows the system. This platform may be a ship, a helicopter, a remote controlled vehicle operating above or below the water surface, or a slow moving aircraft. Minesweeping systems generally have therefore involved a trade-off of performance vis-a-vis size and weight.

Prior art systems to date have included sweep systems using open loop magnetic technology, wherein electrical current is distributed between two or more towed electrodes and the intervening seawater between the multiple electrodes is used as the electrical return. One such system, the Mk-105, utilizes a vehicle towed by a helicopter with a gas turbine power plant on the hydrofoil to generate electricity for the open loop electrodes. The Mk-105 system is powerful, but also quite large and heavy, thus requiring the hydrofoil vehicle. In general, however, the most efficient means to achieve a large magnetic field is to use the open loop means of generating the field. Thus, a ship or helicopter-hydrofoil system has generally been required for the towing. Further, such open loop systems require sufficient physical handling equipment to handle the two or more electrodes, including the appropriate deployment and retrieval of the multiple electrodes as well as maintaining the multiple electrodes separated from one another for proper functioning and to avoid tangle.

An alternative prior art sweep system, for example the SWIMS system, generates the magnetic influence field utilizing conventional dipole technology with large magnetic cores. Because of the size and weight associated with this technology, however, the magnetic field is limited by the size and weight of a practical towed body in which the system is housed.

Still further prior art minesweeping systems have involved various coils or permanent magnet solutions which also have size and weight problems that result in limited field strength.

My pending U.S. patent application Ser. No. 09/545,820 now U.S. Pat. No. 6,634,273 filed Apr. 7, 2000, discloses an open loop minesweeping system, but one which is smaller than the above-referenced prior art, lightweight, and having simplified electrode handling. A body is towed in the water by a tow cable, the body towing only one (the first) electrode behind it while still using the open loop means of generating the magnetic field. This is accomplished by having the towed body itself function as the other (second) electrode, either by making the skin of the towed body the electrode or by having removable panels on the skin of the towed body. AC input power of low amperage and high voltage is passed from the primary towing platform to the towed body, the AC power then being transformed and rectified at the towed body.

SUMMARY OF THE INVENTION

The present minesweeping invention also is intended to utilize the open loop means of generating the magnetic field to obtain a powerful field, while overcoming the deficiencies of the prior art to provide a smaller system, a lightweight system, and a system that simplifies electrode handling. The present invention is sufficiently small and stable that it can be utilized with and towed by smaller helicopters, smaller water vehicles or remotely operated vehicles. The invention is adapted to a wide variety of littoral or deep water operations, for example to clear mined ports or offshore areas or off a beachhead or deep water areas such as choke points.

The present invention includes a body to be towed in the water by a tow cable, the body containing hydrodynamic control surfaces and designed to provide a high-speed and stable tow. The body provides the means to generate the magnetic influence signatures, and the body may also include transducers to generate acoustic influence signatures. A significant aspect of the present invention, as in my above-referenced pending patent application, is that the towed body also does not tow multiple electrodes behind it to generate magnetic signatures, but rather only tows one (the first) electrode behind it while still using an open loop means of generating the magnetic field. This is accomplished in the present invention by having the other (second) electrode positioned along the tow cable itself ahead of the towed body. In particular, a plurality of spaced fairings may be attached to the tow cable. Each fairing has a first conductive portion electrically isolated from the conventional electromechanical tow cable, and a second non-conductive portion mechanically attached to the tow cable. The conductive portions of the fairings are electrically connected together to form the second electrode which is electrically fed from the towed body. Since the towed body only tows one cable which contains the first electrode extending behind the towed body, the physical handling equipment for the single cable is thus considerably simplified as contrasted with what is needed for open loop systems handling and towing multiple cables, each with electrodes. As an alternative to the fairing approach, the other (second) electrode may be an electrode cable positioned along and tied to the tow cable.

Open loop power and control systems generally provide an input AC power which is then rectified to DC power and controlled to either continuous level or to relatively low frequency (pulsed) waveforms. This rectification and conditioning generally are done on the primary towing platform, i.e., the helicopter or ship, which requires weight and space, and requires large diameter cables to handle and pass the large DC currents associated with open loop sweeps. Particularly when the primary towing vehicle is a helicopter, the cable with DC power from the helicopter to the towed body is in air and thus presents difficulties in cooling absent such a large diameter cable. Accordingly, in a further aspect of the present invention, as in my above-referenced pending patent application, AC input power of low amperage and high voltage is passed from the primary towing platform to the towed body, enabling the use of a lower weight cable of small diameter that can be handled by a small helicopter. The AC power is then transformed and rectified at the towed body.

Although the transformer and rectifier components would normally generate excessive and damaging heat at the towed body, the heat is dissipated in the present invention, as in my above-referenced pending patent application, by exposing the transformer and rectifier components at the towed body directly to the sea water. These components are not retained within a watertight enclosure with cooling mechanisms, but are encapsulated within a thin waterproof coating directly exposed to the sea water, the coating protecting the components from the conductive sea water but otherwise cooling the components by passing heat through the thin coating directly to the sea water. Maximum cooling is obtained, and the components can be of significantly reduced size and weight from that which would be required by alternative forms of cooling at the towed body.

The body to be towed also may contain a winch to deploy and return the first electrode. The first electrode also may take alternative forms, such as a cable, a rigid sleeve, or a flexible sock as disclosed in my above-referenced pending patent application.

Other features and advantages of the present invention will be apparent from the following description, drawings and claims.

BRIEF DESCRIPTION OF THE DRAWINGS

FIG. 2 illustrates in detail the towed body used in the present invention;

FIG. 5 illustrates the power conversion elements used in the present invention.

DETAILED DESCRIPTION OF EMBODIMENTS

Figure 1:
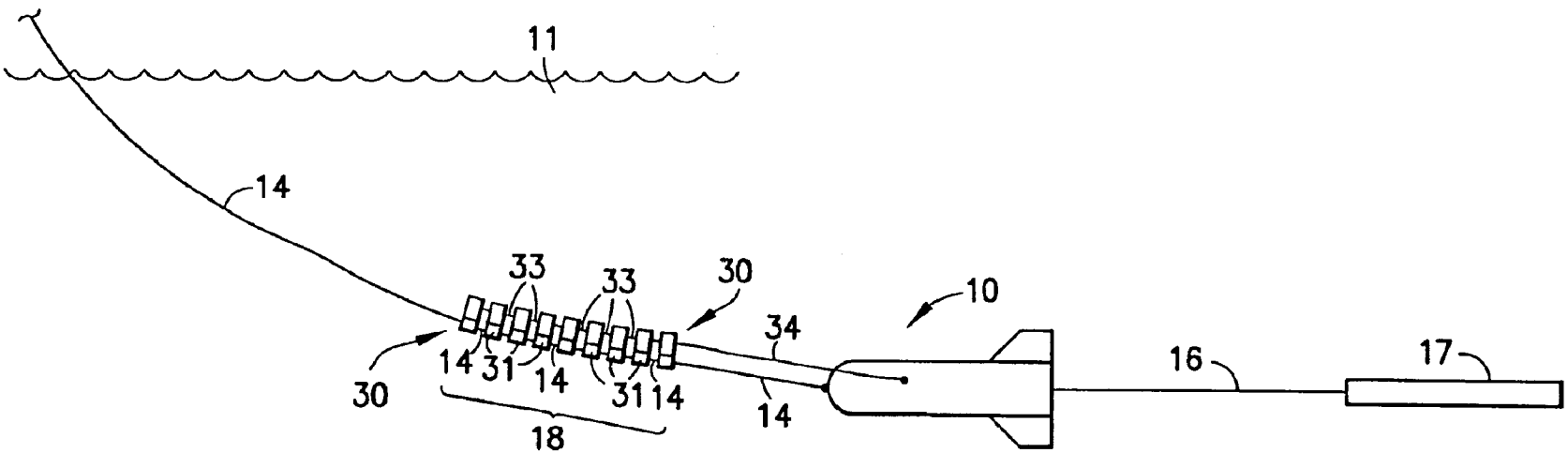
FIG. 1 is a schematic view of the present invention as it would be towed through the sea water.

Referring to FIGS. 1 and 2, towed body 10 is illustrated which is generally shaped in a torpedo-like, streamlined fashion for smooth, fast and stable passage through the seawater 11. Body 10 when towed may be submerged, and includes rear hydrodynamic fins 12 and possibly hydrodynamic wings 13 to control the orientation, depth and direction of the towed body. As illustrated, electromechanical tow cable 14 is connected at one end to the towed body 10 at connector mechanism 15, and the other end of tow cable 14 may be connected to a winch mechanism on the towing platform (for example on a towing helicopter, not shown). The towing platform also will have means to cradle and carry the towed body 10 when not in minesweeping use from one location to another. The towing platform additionally will have power means to provide AC power of low amperage and high voltage down tow cable 14 to the towed body 10. As previously noted, the providing of AC power of low amperage to the towed body allows the power cable along tow cable 14 to be of small diameter and light weight as compared to cables providing high DC current from the towing platform to the towed body.

Figure 3:
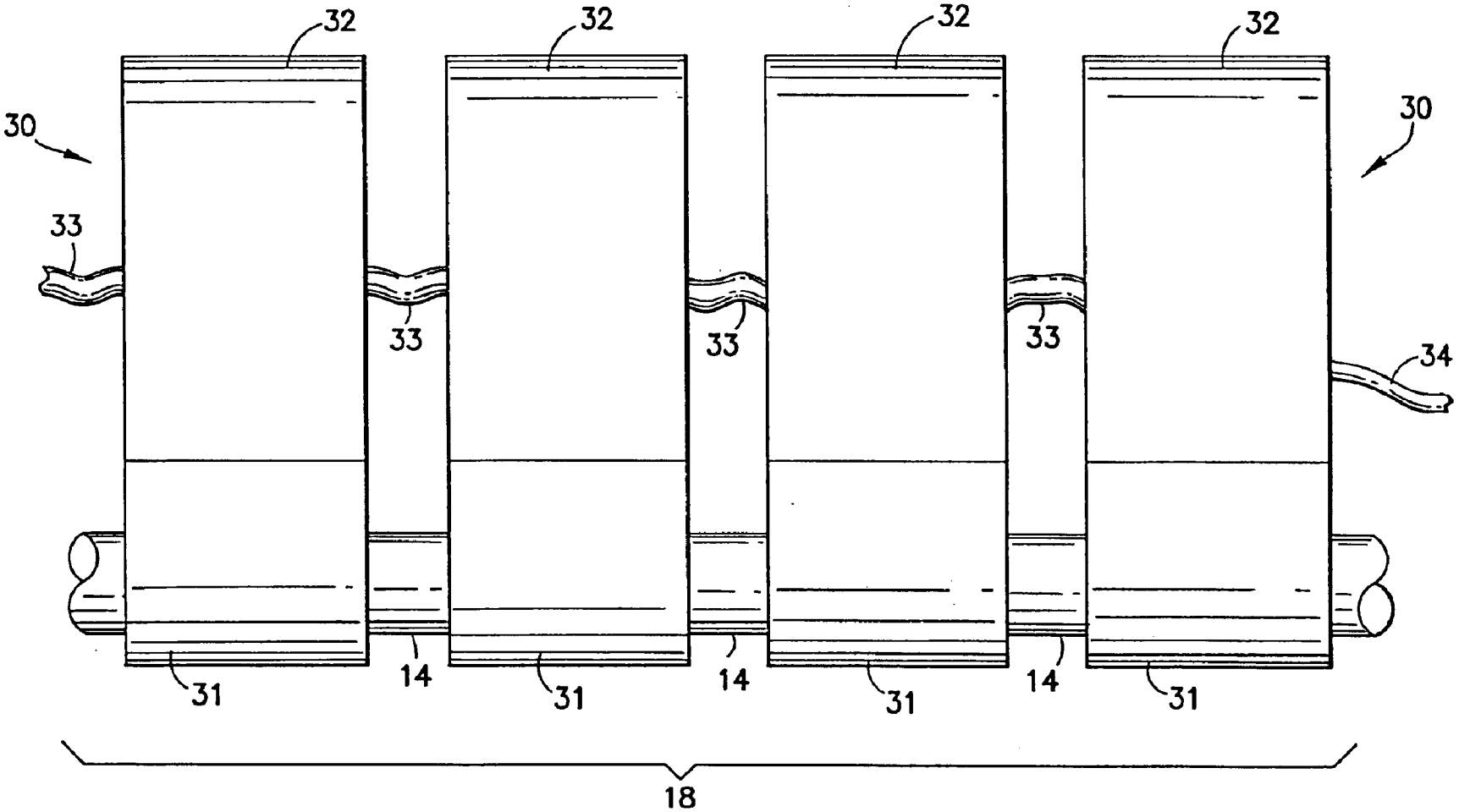
FIG. 3 is a side elevational view illustrating in detail certain of the fairings including the second electrode elements of the present invention as positioned along the tow cable.
Figure 4:
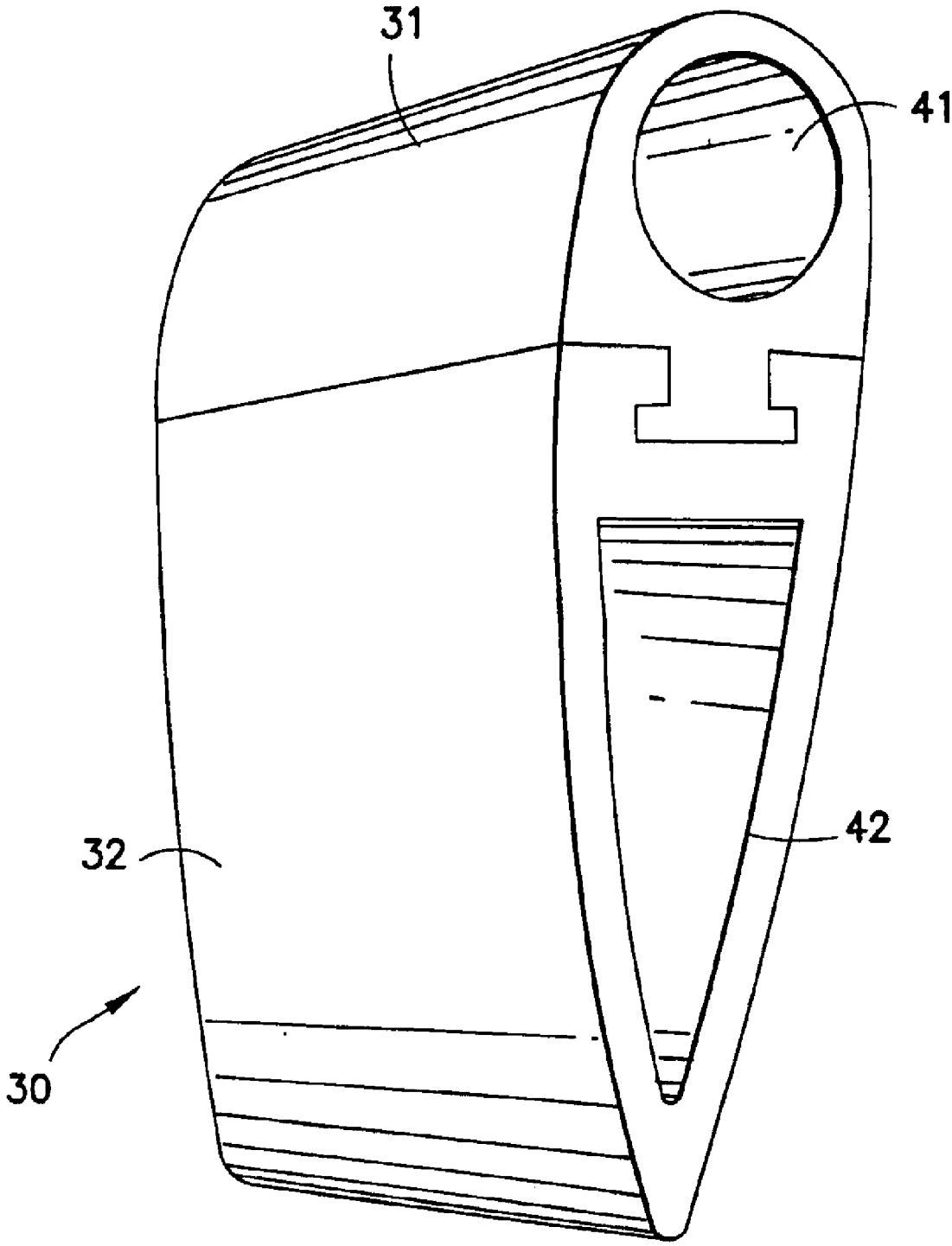
FIG. 4 illustrates in perspective one of the fairings of the present invention.

Extending rearwardly from towed body 10 when it is in minesweeping operation is an insulated and waterproof, sweep separation cable 16 and the aft (first) anode electrode 17 in cable form. Cable 16 and electrode 17 may be non-buoyant to minimize size and drag, and are of standard known design. The open loop magnetic method of minesweeping requires a second electrode, but in the present invention, there is no second electrode towed behind towed body 10. Rather, a cathode electrode 18 is shown schematically in FIG. 1 extending along the electromechanical tow cable 14 in front of towed body 10. It should be understood that the anode and cathode functions may be reversed between the respective electrodes. Electrode 18 is separated from the front of towed body 10 by at least several feet. It is know to utilize a plurality of streamlined fairings along a tow cable to reduce drag and strumming, and for stabilizing the tow of body 10. In the present invention, referring to FIG. 3, a plurality of fairings 30 are mechanically attached to electromechanical tow cable 14, but at least a portion of each fairing is electrically isolated from cable 14. Each fairing 30 for example has a plastic nose piece 31 which surrounds tow cable 14, and a tail piece 32 which comprises electrically conductive metal which is electrically isolated from tow cable 14 by the plastic nose piece 31. The metal tail pieces 32 are electrically connected together by flexible electrical conductors 33 so that the tail pieces 32 of all the fairings 30 form the second electrode 18 of the present invention. Four of such fairings are shown in blown-up detail in FIG. 3, and an individual fairing is shown in perspective in FIG. 4. Insulated and waterproof separation cable 34 extends from the fairing nearest towed body 10 back to the towed body and is connected to the DC power source situated on body 10 as further described below. As shown in FIG. 4, each fairing 30 has a hole 41 for tow cable 14 to pass through plastic nose piece 31. Each fairing 30 further has a hole 42 for electrical conductors 33 which are connected to each tail piece 32 in any suitable manner.

Second electrode 18, merely as an example, may be from fifty or less feet up to two hundred or more feet in length, and there may be for example three f airings per foot of tow cable 14, for a total of several hundred fairings. Since the fairings 30 are capable of moving to a degree along tow cable 14, permanent ring members may be swaged to cable 14 at given distances (i.e., thirty feet) to prevent the fairings 30 from excessively bunching up along cable 14. Accordingly, the several hundred electrically conductive fairing tail pieces 32, as electrically connected together by conductors 33, form the second electrode 18. Cathode electrode 18 is insulated from electrode 17, and the return path from electrode 17 to electrode 18 is through the intervening sea water 11. It will be apparent that there are not two towed cables behind towed body 10 to be separately handled and maintained in a tangle-proof state.

Electrical conductors 33 extending between fairings 30 also serve additional mechanical functions in that they are strung tightly enough to prevent adjacent fairings from excessive rotation in respect to each other, but are also strung loosely enough to allow spacing between adjacent tail pieces to increase as required when the tow cable is wound over a drum in known fashion.

DC electrical power as noted is provided across electrodes 17 and 18 for the open loop magnetic method of minesweeping. Since AC power of low current and high voltage is provided to towed body 10 along tow cable 14, the high voltage, low current AC is transformed to low voltage, high current AC at the towed body 10 by transformer 19, and is then rectified by rectifier 20 to provide the constant level or pulsed DC power required. The power conversion electrical elements are shown schematically at cut-out 21 in FIG. 2, and as transformer 19 and rectifier 20 in FIG. 5.

Additionally illustrated schematically in FIG. 2 at cut-out 22 is an acoustic device that may take various well-known forms. One or more such transducers may be located in towed body 10. Accordingly, towed body 10 provides complementary magnetic and acoustic influence signatures for minesweeping. The acoustic source generally will produce a sweep path width that equals or exceeds the magnetic sweep path width, in order to deal with dual influence mines.

The sweep cable 16 and aft electrode 17 may be stowed on a small winch 23 contained within an open and hollow rear end of towed body 10, cable 16 and electrode 17 being deployed therefrom to the FIG. 1 position during minesweeping and reeled back into towed body 10 after use prior to retrieval of towed body 10. The winch 23 may be controlled from control signals from the towing platform.

Referring to FIG. 5, transformer 19 and rectifier stack 20 generate considerable heat in operation. Rather than utilizing enclosed waterproof boxes and cooling plates aboard towed body 10, the transformer 19 and rectifier 20 are each completely encapsulated within very thin and conformal waterproof coatings 24, 25 respectively of material which may for example be a moldable polymer. The sealed transformer 19 and rectifier 20 are in turn mounted on towed body 10 so that the encapsulation layers 24, 25 are directly exposed to the sea water, thereby allowing heat conduction directly through the thin layers 24, 25 to the sea water. The transformer 19 and rectifier 20 may for example be mounted in an internal cavity of body 10, which cavity is flooded with sea water. Alternatively, they may be mounted in a pocket in the side wall of towed body 10 exposed to the sea water. Alternatively a tunnel may pass through a portion of towed body 10 through which sea water passes, the transformer 19 and rectifier 20 then being mounted within or on the side wall of said tunnel. Waterproof pigtails 26 shown schematically in FIG. 5 in turn pass between transformer 19 and rectifier 20 respectively and the power connections internal to towed body 10. This cooling aspect of the present invention provides for very efficient cooling and component design to minimize size and weight on the towed body 10.

Solely as an exemplary embodiment of one form of the present invention, the following parameters may apply in addition to the parameters of electrode 18 mentioned above:

| | |
|---|---|
| Length of towed body 10 | 10 feet |
| Diameter of towed body 10 | 16 inches |
| Length of sweep cable 16 | 250 feet |
| Length of anode electrode 17 | 150 feet |
| Diameter of cable 16 and electrode 17 | .65 inches |
| Diameter of cable 34 | .40 inches |
| Length of cathode electrode | 150 feet |
| AC power along towing cable 14 | 19 kilowatts |
| DC current to anode electrode 17 | 400–1000 amps |
| DC power to anode electrode 17 | 16 kilowatts |
| Weight (in air) of towed body | 1000 pounds |
| Tow speed of system | Up to 50 knots |
| Field strength | 4 MGauss |
| Weight (in air) of cable 16 and electrode 17 | 230 pounds |
| Length of a fairing 30 in the direction of cable 14 | 3–6 inches |
| Length of a fairing 30 perpendicular to cable 14 | 4–6 inches |

It will be seen from the above parameters that a very light weight, small size open loop magnetic field system is provided, including simplified electrode handling and efficient cooling.

It will be appreciated by persons skilled in the act that numerous variations and/or modifications may be made to the invention without departing from the spirit and scope of the invention. The present embodiments are, therefore, to be considered as illustrative and not restrictive.

What is claimed is:

1. A plurality of fairings for use in an open loop magnetic field minesweeping system having a towed body and a sweep cable and electrode extending rearwardly from the towed body, said towed body to be towed through sea water by a towing cable extending forwardly of the towed body and connected between the towed body and a helicopter, other aircraft vehicle or marine vehicle, wherein each of the plurality of fairings is a separate discrete unit having a non-conductive portion for attaching to said towing cable and an electrically conductive portion electrically isolated by the non-conductive portion from the towing cable, said electrically conductive portions being electrically connected together to form an electrode forward of the towed body to be powered from the towed body.

2. The plurality of fairings of claim 1, wherein said electrically conductive portions are electrically connected together by flexible electrical conductors.

* * * * *